US008713729B2

(12) United States Patent
Malakhov

(10) Patent No.: US 8,713,729 B2
(45) Date of Patent: May 6, 2014

(54) DEVICES AND SYSTEMS FOR SUPPORTING A USER

(76) Inventor: Mikhail P. Malakhov, San Francisco, CA (US)

( * ) Notice: Subject to any disclaimer, the term of this patent is extended or adjusted under 35 U.S.C. 154(b) by 7 days.

(21) Appl. No.: 13/340,343

(22) Filed: Dec. 29, 2011

(65) Prior Publication Data

US 2012/0186020 A1 Jul. 26, 2012

Related U.S. Application Data

(60) Provisional application No. 61/428,215, filed on Dec. 29, 2010.

(51) Int. Cl.
*A47B 7/00* (2006.01)

(52) U.S. Cl.
USPC ..... 5/623; 5/607; 5/621

(58) Field of Classification Search
USPC ..... 5/607, 621–625, 627, 632
See application file for complete search history.

(56) References Cited

U.S. PATENT DOCUMENTS

| | | | | |
|---|---|---|---|---|
| 27,835 | A * | 4/1860 | Selden | 5/102 |
| 2,466,264 | A | 5/1949 | Nelson | |
| 4,175,550 | A | 11/1979 | Leininger et al. | |
| 4,300,249 | A | 11/1981 | Taylor | |
| 4,920,589 | A | 5/1990 | LaVelle et al. | |
| 4,934,002 | A * | 6/1990 | Watanabe | 5/607 |
| 5,161,275 | A * | 11/1992 | Simpson et al. | 5/627 |
| 5,448,790 | A * | 9/1995 | Saro et al. | 5/657 |
| 5,561,878 | A | 10/1996 | Ruehl | |
| 5,860,899 | A * | 1/1999 | Rassman | 482/142 |
| 6,460,207 | B1 * | 10/2002 | Papay et al. | 5/640 |
| 6,640,363 | B1 * | 11/2003 | Pattee et al. | 5/601 |
| 8,468,629 | B2 * | 6/2013 | Beevers et al. | 5/655 |
| 2003/0167569 | A1 * | 9/2003 | Newkirk et al. | 5/613 |
| 2004/0011779 | A1 | 1/2004 | Krywiczanin et al. | |
| 2006/0085913 | A1 | 4/2006 | Kawakami et al. | |
| 2006/0185090 | A1 | 8/2006 | Jackson | |
| 2006/0253985 | A1 * | 11/2006 | Skripps | 5/622 |
| 2007/0107125 | A1 * | 5/2007 | Koch et al. | 5/600 |
| 2009/0307845 | A1 * | 12/2009 | Rao et al. | 5/622 |
| 2009/0308400 | A1 * | 12/2009 | Wilson et al. | 128/845 |

* cited by examiner

*Primary Examiner* — Robert G Santos
*Assistant Examiner* — Richard G Davis
(74) *Attorney, Agent, or Firm* — Thibault Patent Group

(57) ABSTRACT

A device for supporting a user includes a frame for supporting the torso of the user. The frame may be oriented in a left, middle and right orientations. The user's arms extending through openings, which permit the user to position the arm adjacent the frame without the user's body weight on the user's shoulder or arm.

26 Claims, 6 Drawing Sheets

DEVICES AND SYSTEMS FOR SUPPORTING A USER

CROSS-REFERENCE TO RELATED APPLICATIONS

The present invention claims priority from U.S. Provisional Application No. 61/428,215 filed on Dec. 29, 2010 by Mikhail Malakhov. The disclosure of which is hereby incorporated by reference for all purposes.

FIELD OF THE INVENTION

The present invention is directed to devices and systems for supporting a user. In particular, the present invention is useful in supporting a user during sleep. The present invention suspends the user's torso and allows the user to comfortably position an arm beneath the torso in a natural position without having any pressure on the shoulder. The problem with conventional beds is that the user's arm, and particularly the shoulder, can take a significant amount of body weight when the user is sleeping on the left or right side. The present invention is useful for sufferers of chronic shoulder pain and post-surgical patients. The device is also useful for neck and back pain sufferers, snorers, pregnant women, and acid reflux sufferers. The device may be particularly useful for immobile, restricted mobility, and unconscious patients in both homecare and hospital settings.

BACKGROUND OF THE INVENTION

During 2006, approximately 30% of adults reported experiencing some type of joint pain during the preceding 30 days. Knee pain was reported by 18% of respondents, followed by shoulder pain (9%), finger pain (7%), and hip pain (7%). Joint pain can be caused by osteoarthritis; injury; prolonged, abnormal posture; or repetitive motion. According to the American Academy of Orthopaedic Surgeons, about 4 million people in the United States seek medical care each year for shoulder sprain, strain, dislocation, or other problems. Each year, shoulder problems account for about 1.5 million visits to orthopaedic surgeons.

Shoulder pain is prevalent among people of advanced age and those who suffer from rheumatoid arthritis, spinal cord injury, stroke, and Parkinson's disease. An important detail that distinguishes shoulder pain from other forms of musculo skeletal pain is the prevalence of sleep related symptoms. A plethora of clinical studies have shown that nocturnal pain, insomnia, and inability to sleep on the affected side are prominent features of shoulder pain. Furthermore, patients sometimes report that they experience shoulder pain for the first time when they wake up at night or in the morning, without prior warning or a specific inciting event.

Most commonly, shoulder pain is associated with trauma or overuse. However, the overuse theory cannot explain adequately the occurrence of shoulder pain in those who do not engage in activities that involve repeated and stressful use of the shoulder, since the percentage of the painful right shoulders usually does not match the percentage of dominant right arms in such individuals. An alternative hypothesis, well substantiated by statistical evidence, has linked shoulder pain to postural immobility in the decubitus position (J. Zenian, Sleep Position and Shoulder Pain. Medical Hypotheses, 2010, volume 74, page 639-643). Indeed, prolonged pressure on the shoulder caused by the weight of the thorax can produce enough damage to cause subsequent shoulder pain. Furthermore, infraspinatus, and posterior deltoid muscles of both shoulders (in contact with the bed and the opposite) become overstretched and cause pain (J. Travell, D. Simons, L. Simons; 1999, Myofascial Pain and Dysfunction: The Trigger Point Manual. USA: Lippincott Williams & Williams. ISBN 0-683-08363-5). Many shoulder pain sufferers find sleeping on the side painful. The intense pressure exacerbates shoulder pain, interferes with sleep, and can lead to soreness in the neck and arm, as well as numbness in the involved extremity. Some shoulder pain sufferers resort to sleeping on their backs, and, as a consequence, experience apnea. There is a significant body of evidence demonstrating that for many snorers, both non-obstructive and obstructive sleep apnea is position-specific and occurs while sleeping on the back. Sleeping in a semi-seated position or in a lateral decubitus position prevents snoring for these patients and both simple (e.g., sewing a tennis ball to the back of pajamas, sleeping in a recliner) and complex (H. Loord, E. Hultcrantz. Positioner—a method for preventing sleep apnea. Acta Oto-Laryngologica, 2007; 127: 861-868) methods to prevent back sleeping are recommended. Commonly suggested solutions for minimizing the impact on shoulders while side sleeping include high pillows, a thick blanket tacked under the torso so that a gap for placing the shoulder (between the pillow and blanket) is formed. Some sleepers find sleeping on a couch, with the back leaning against the back of the couch, more comfortable. Those who sleep on their sides often experience chronic neck and back pain due to spinal misalignment.

DESCRIPTION OF THE PRIOR ART

For a long time, there has been a need in the art to provide pillows, cushions, mattresses, recliners and other devices for facilitating the positioning, rest or sleep of a user while the body of the user is comfortably disposed and while the spine, neck, shoulders and extremities are properly aligned. References such as U.S. Pat. No. 1,045,228 and U.S. Pat. No. 2,933,738 disclose simple pads for use in conjunction with mattresses while U.S. Pat. No. 3,626,526 and WO2011/130714A2 disclose a compound, multilayered mattress formed with a plurality of cut-outs. Other cushions and pillows such as those found in U.S. Pat. No. 4,173,048, U.S. Pat. No. 3,938,205 and U.S. Pat. No. 4,624,021 disclose discreet, unitary pillows designed to be placed adjacent to, and to partially underlie or be engaged by a reclining user, while supports and other cushions such as those found in U.S. Pat. No. 4,441,221 and U.S. Pat. No. 4,635,306 are dedicated principally to engaging the front or reverse of a user's torso, typically while the user remains in a sitting, or partially reclining position. A variety of body pillows such as those found in U.S. Pat. Nos. 4,901,384 and 5,097,551 relate to pillows for supporting a sleeper reclining on the side.

There has been a further need in the art to provide mattresses, beds, frames and other devices for patients with limited mobility, immobile and unconscious patients. These devices are designed to facilitate or automate patient turning to prevent pressure sores (bed sores), improve blood circulation and prevent accumulation of fluid in the lungs. Chinese patent CN 2657639 is an electric body-turning bed, which comprises a bed body and a body-turning control mechanism, wherein the body-turning control mechanism consists of a double-slide support. U.S. Pat. No. 2006123552 describes a device with six inflatables which turn the patient through sequential inflation and deflation.

Most sleepers, whether they sleep on the side or on the back, flex the hips and knees for more comfort. Placing a pillow between legs prevents leg on leg pressure and maintains proper spinal alignment. Commonly, a rolled blanket or pillow is placed under the legs in supine position or between legs in lateral decubitus position. The relevant art includes variety of supports (pillows, cushions, etc.) that provide flexion, separate the knees (Pub. No. US 2003/0046767 A1), or both (e.g., U.S. Pat. No. 5,117,522, U.S. Pat. No. 4,910,818, U.S. Pat. No. 5,125,123, Pub. No. US 2001/00227577 A1, PCT/US98/24925). The body of a sleeper in lateral decubitus position should preferably be maintained not at 90 degree relative to sleep surface, such as mattress or floor, but at approximately 60 degree for better distribution of sleeper's weight between the side and back of the torso. This is possible while sleeping on the couch or while using the device described here. For the proper leg-torso alignment, a leg support device should not only separate the knees and provide flexion, but should also maintain the legs of the sleeper at the same angle as the torso. None of the supports described in the prior art have provided that.

A great variety of sophisticated mattresses and specialized pillows have been described in prior art; however, all of them fall short of providing a comprehensive solution that would address the thorax pressure on the shoulder, proper spine-neck-legs alignment, arm-hand support while in decubitus position, and thorax-neck-head elevation while in supine position. Accordingly, there is currently a need for a device that allows a sleeper to maintain a proper spinal alignment, distribute the body weight between the side and back, and eliminate impact on the shoulders.

SUMMARY OF THE INVENTION

The present invention provides a device and system which is capable of orienting the user in a left orientation, in which the user's left arm is lower than the right arm; a right orientation, in which the user's right arm is lower than the left arm; and a middle orientation where the arms are at the same elevation. When in the left and right orientations, the user is supported by a frame which prevents the user's weight from loading the user's shoulder. The frame also has left and right openings through which the user's arms extend. The openings permit the user to position the arms adjacent the torso without body weight on the user's shoulder.

The present invention may be practiced using numerous different mechanisms of motion, so long as the user may be oriented and supported in the desired manner. In one specific embodiment, it has been discovered that the problems left unanswered by known art can be solved by providing a sleeping system that includes the following elements:

A. A frame, which supports user's torso elevated above the sleep surface, so that there is no impact on the shoulder in lateral decubitus position. The frame comprises a back board and side walls, extending from armpit to pelvis, attached to the back board.

B. An angle restrictor on each side of the back board,

C. A hump that elevates the torso into a semi-seated position (Fowler's) and facilitates transition from side to side.

D. The angle restrictor, hump, and parts of back board jointly determine the angle at which the torso is held with respect to the sleep surface.

E. A head support attached to the frame.

F. Shoulder braces which extend from the frame over the sleeper's shoulders and provide mild pressure on the fore-shoulder.

G. A leg support device that holds the legs flexed and separated, and, has support surfaces that determine the angle at which the legs are held with respect to the sleep surface and thus maintains alignment of the legs and torso.

All elements contribute to the elimination of shoulder pain, better muscle relaxation, deeper sleep, reduction of apnea, improved posture and reduced back pain.

In the preferred embodiment, the components of the assembly (i.e., frame, head support, seat, leg support, etc.) are made to fit the individual user's body shape and size, and result in support and adjustability that cannot be achieved with known devices. In particular, the disclosed invention produces new and useful results in the support of the head and legs relative to the neck, spine and shoulders. In other embodiments the components of the assembly, (i.e., frame, head support, seat, leg support, etc.) can be made expandable to accommodate users of various sizes and shapes. The components defining the positioning of elements and assembly (i.e., angle restrictors, hump) can be made adjustable to vary the inclination angles of the user's body.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it is understood that numerous changes in the preferred embodiments of the herein disclosed invention are meant to be included within the scope of the invention.

BRIEF DESCRIPTION OF THE DRAWINGS

The device described herein may be understood by reference to the following figures.

DESCRIPTION OF THE PREFERRED EMBODIMENTS

Figure 1:
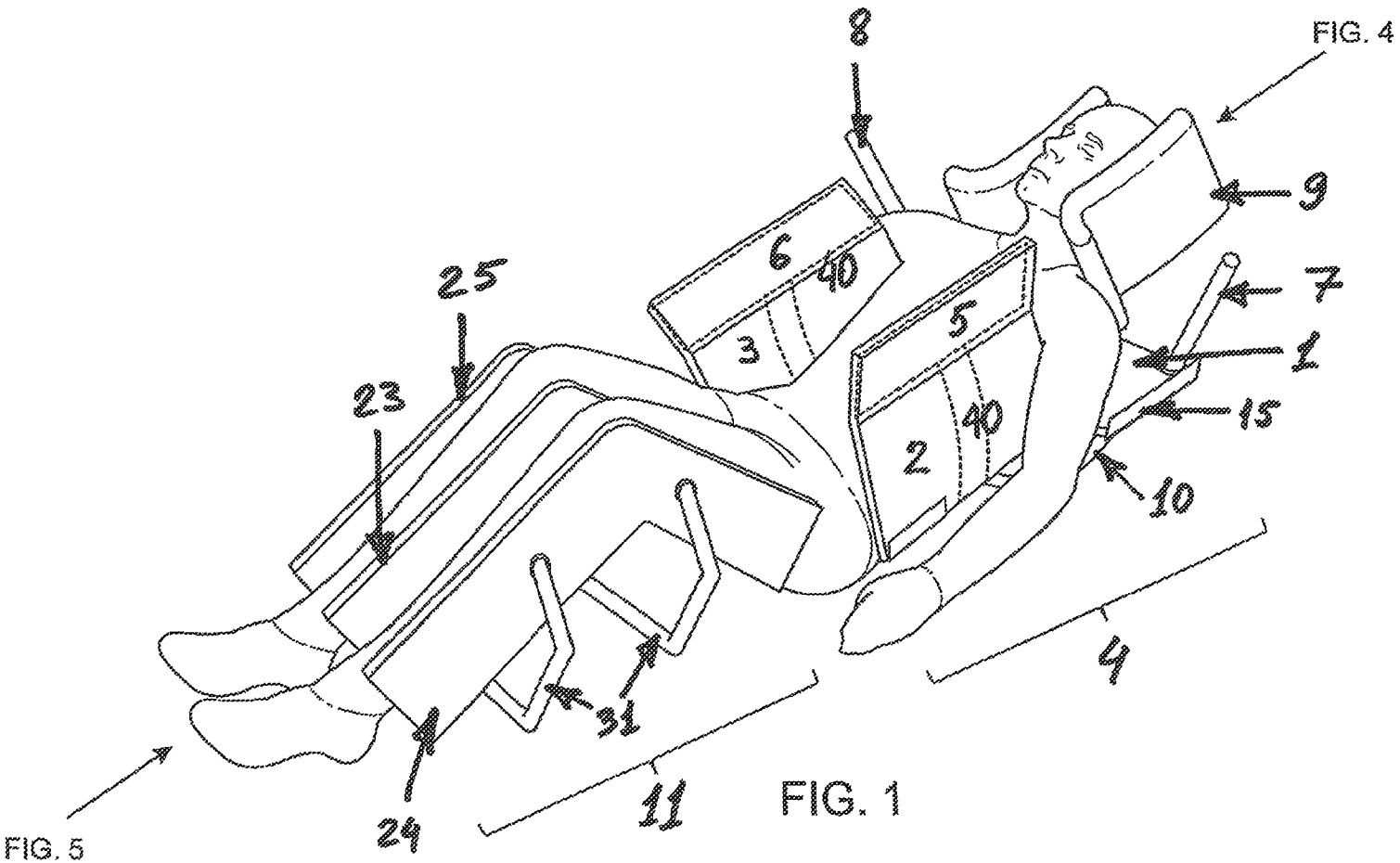
FIG. 1. The assembly with resting user in the middle orientation.
Figure 2:
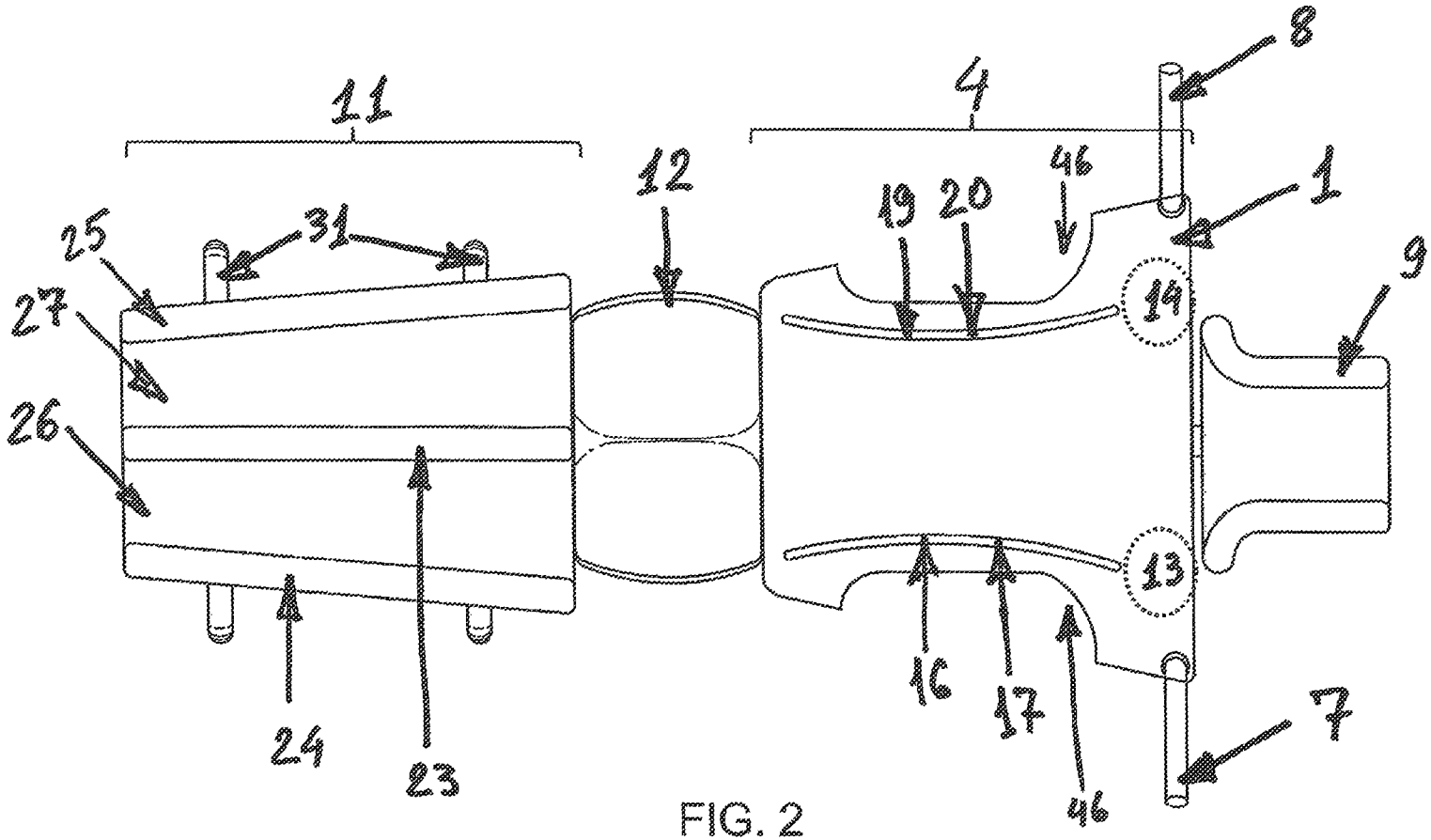
FIG. 2. Top view of the system. The frame (without upholstery) with attached head support, angle restrictors, leg support, and seat are shown.
Figure 3:
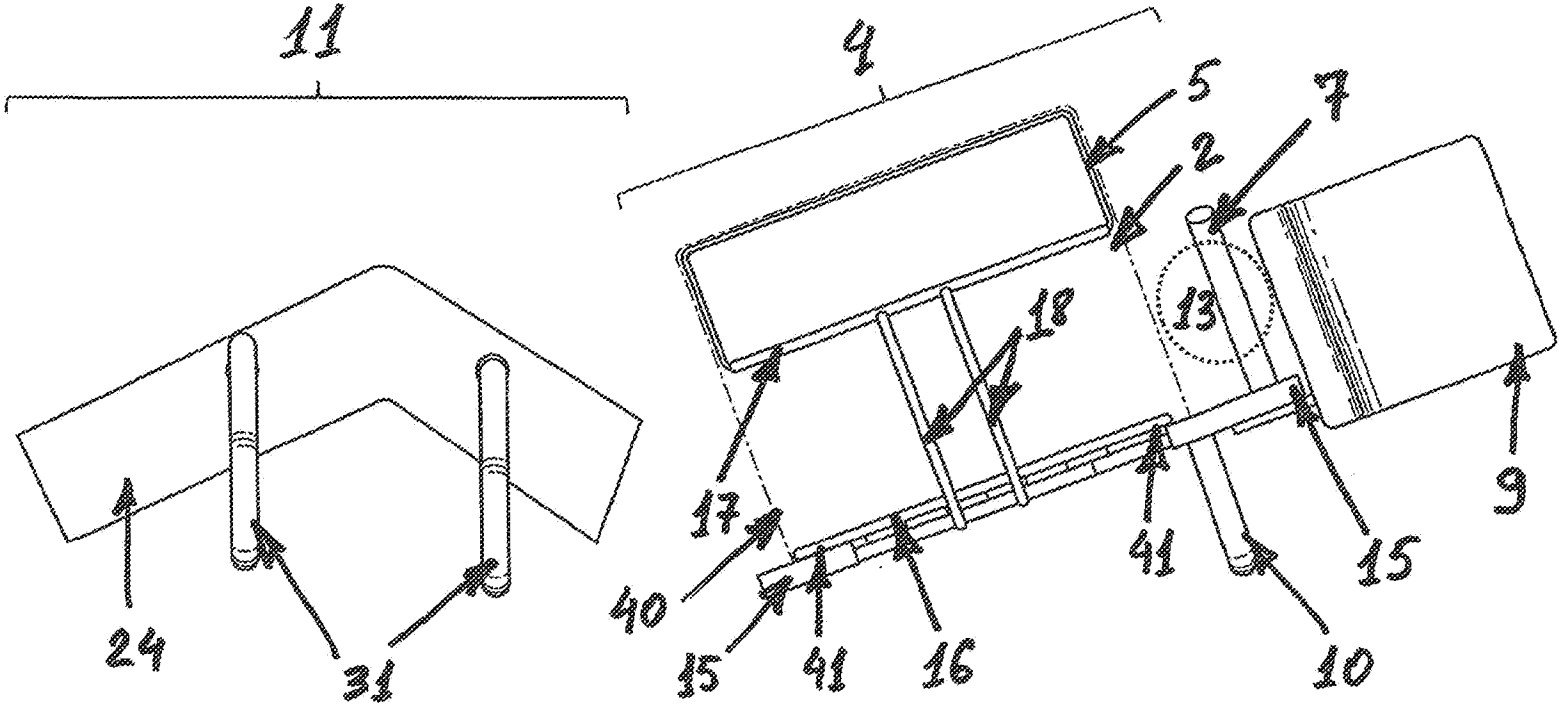
FIG. 3. Side view of the system in the middle orientation (low Fowler's). The frame with hand support (upholstery shown with dotted line), head support, angle-restrictors and leg support are shown.

The system shown in FIGS. 1-3 consists of a back board 1 and side walls 2,3 jointly forming a frame 4. The system also includes, hand support 5,6, angle restrictors 7,8, a head support 9, a hump 10, and a leg support 11. The frame 4 and leg support 11 can be coupled via a seat 12 as shown in FIG. 2. Throughout the description of the preferred embodiments, all discussion of "left" or "right" shall be equally applicable to the other side and discussion of one side is equally applicable to the other.

Figure 5A:
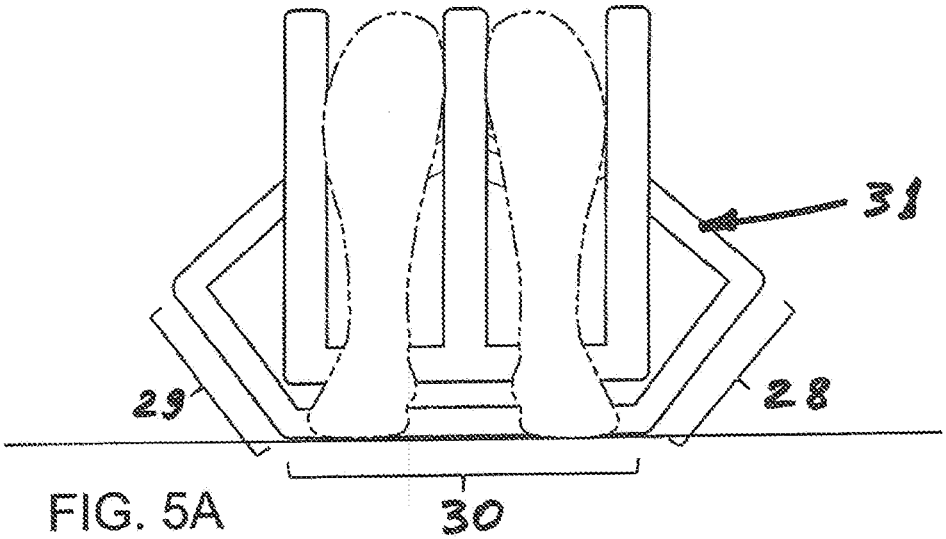
FIG. 5A. Leg-end view in the middle orientation. Leg support comprised of walls, grooves, and support surfaces is shown.

A frame 4 which supports the torso of the user has a left opening 13, depicted in FIGS. 2,3, formed by the back board 1 and left side wall 2 through which the user's left arm extends, as illustrated in FIG. 1. The frame 4 also has the right opening 14 through which the user's right arm extends. The frame 4 is positionable in a middle orientation which positions the left and right arms at the same elevation as illustrated in FIG. 1. The user lies within the frame 4 and may remain in the middle orientation or rotate to the left or right orientations and back. The frame 4 is configured to support the user in a left orientation in which the left arm is below the torso, the left arm being positionable adjacent to the torso without the user's body weight on the left arm and shoulder, as illustrated in FIG. 5A. Similarly, the frame 4 supports the torso of the user in the right orientation in which the right arm is below the torso, the right arm being positionable adjacent to the torso without the user's body weight on the right arm and shoulder.

Figure 4A:
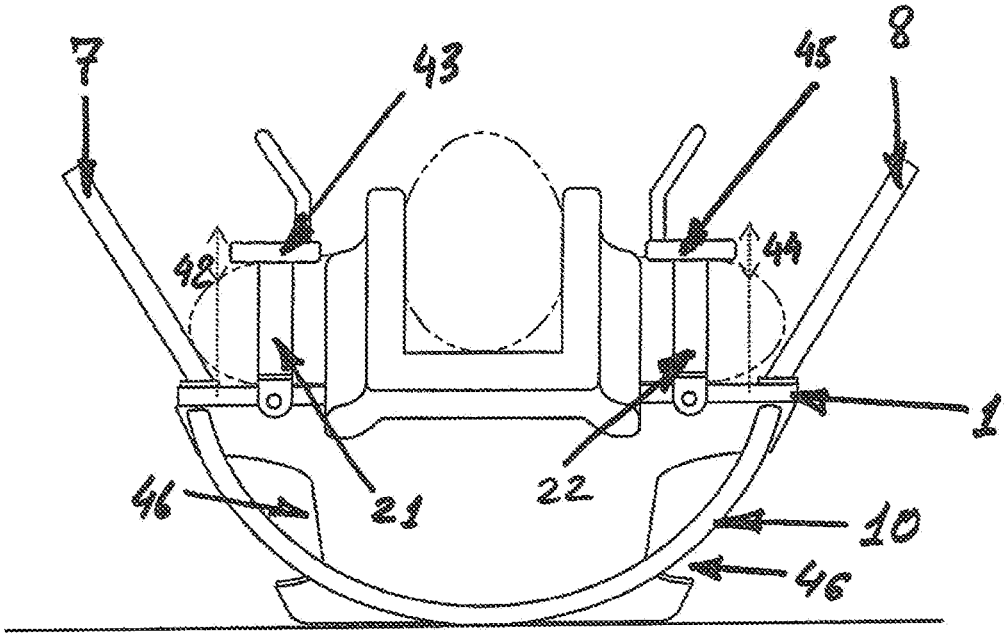
FIG. 4A. Head-end view in the middle orientation (low Fowler's). The frame with hand support, attached head support, angle-restrictors, shoulder-braces, and hump are shown.

In the preferred embodiment the frame 4 is coupled to a hump, 10 thereby supporting the user in the middle orientation, as illustrated in FIGS. 1-4A, in low Fowler's position, i.e. with torso elevated 15-30°) and head 20-70 cm above the ground. Alternatively the frame 4 can be configured to accommodate semi-Fowler's)(30-45°) and Fowler's positions)(45-60°. In the alternative embodiment, as will be shown below, high Fowler's)(60-90°) position can also be achieved. The hump 10 serves a dual purpose and in addition to elevation of the user into low Fowler's position, it facilitates transitioning between the left, middle, and right orientations. In the preferred embodiment, the hump 10 is coupled to the upper half of the back board 1, as illustrated in FIGS. 3, 4B, 4A; however, it can also be coupled to head support 10 and can be made solid with no opening between the hump 10 and the back board 1. The hump 10 can be made of any material, such as metal, wood, or plastic. Sleeping on the sides or with the torso elevated significantly reduces apnea and is also recommended for acid reflux sufferers.

Figure 4B:
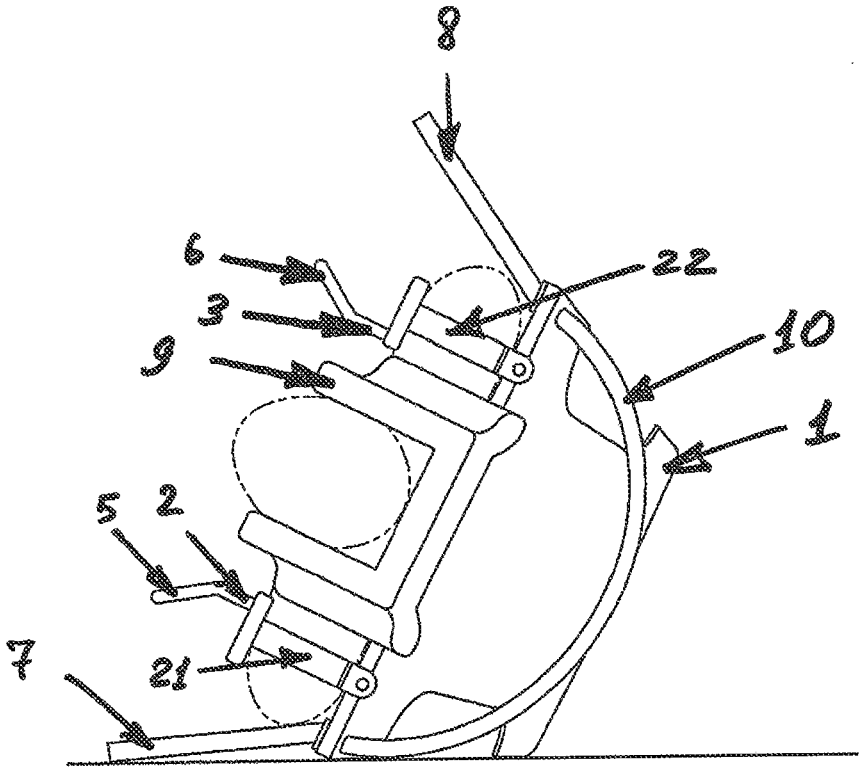
FIG. 4B. Head-end view in the left orientation (left lateral decubitus position). The frame with hand support, attached head support, angle restrictors, shoulder braces, and hump are shown.

The frame 4 has left support surface(s) 15 in FIG. 1 and corresponding right support surfaces, the frame 4 being supported by the left support surface 15 when in the left orientation; the frame being supported by the right support surface when in the right orientation with the support surfaces contacting the ground. The support surfaces 15 prevent the back board from damaging the bed or the floor on which the device rests, and prevent the device from sinking into the carpet. In the preferred embodiment, the support surfaces 15 of the frame 4 cooperate with the hump 10 and angle restrictor 7 or 8 to stabilize the frame 4 in the left or right orientation, respectively, and define the angle at which the user's torso is inclined relative to the sleep surface or ground, as illustrated in FIG. 4B. By varying the size of the hump 10 and/or an angle at which angle restrictor 7, 8 is positioned relative to the back board 1 it is possible to change the angle at which the user's torso is inclined relative to the sleep surface. The user may choose to be at 90° (frontal plane relative to sleep surface, i.e. true lateral decubitus) and undergo a 180° transition from left to right orientation. The user may choose to be at 100° (i.e. with the upper shoulder leaning slightly forward) and undergo 200° transition from left to right orientation (which may be carried out with other embodiments described herein). In the preferred embodiment of FIG. 1, the frame 4, angle restrictors 7, Band the hump 10 are configured such that the user is leaning 45-65° (frontal plane relative to sleep surface FIG. 4B). These angle limits provide the best weight distribution between the side and the back of the user and promote better rest.

When changing the orientation of the user, substantially the entire device may also change orientation in whole body motion for the device of FIG. 1. As used herein, the term whole body motion shall mean that substantially the entire device moves together and changes orientation when the orientation of the user is changed.

The frame 4 that supports user's torso elevated above the ground, such that there is no impact on the shoulder in lateral decubitus position, is comprised of the back board 1 and side walls 2,3, extending from armpit to pelvis and positioned on the lateral sides of the user's torso. The side walls 2, 3 are formed by two pairs of supporting rods 16,17 in FIG. 3 (16,17,19,20 in FIG. 2) attached to the back board (one pair on each side) and upholstery suspended between the supporting rods, as depicted in FIGS. 1 and 3. Supporting rods 16,19 are attached directly to the back board allowing 3-20 mm gap between the back board and the rod for upholstery attachment, while the other rods 17,20 are elevated above the back board to body's depth (20-30 cm, or more for big people) and is attached to the back board 1 with one, two (as shown here), or more connecting rods 18 positioned around the elbow or waist as depicted in FIG. 3. Supporting and connecting rods 16,17,18,19,20 are typically made of 5-15 mm thick steel rods or bars but can be made of other durable material such as plastic and can have a different shape and attachment site while providing the same functionality. Two supporting rods are provided for each side, and shaped to follow the contours of the body from the armpits to the hips, as depicted in FIG. 2: two supporting rods 16,17 on the left side and two supporting rods 19,20 on the right side.

The device may be made to fit the shape and size of an individual user or may be adjustable to accommodate any particular user.

Back board 1 of the frame 4 may be made of 5-10 mm thick plywood, steel, plastic, or any other suitable material. The dimensions are such that it extends from upper end of buttocks to the base of the neck. On the sides it extends 5-15 cm wider than the shoulder and hip width.

In the preferred embodiment the back board 1 includes left and right elbow recesses 46 as depicted in FIGS. 2 and 4A. Elbow recesses allow comfortable positioning of the arm above the torso. E.g., when in left position the most comfortable position for the right arm is above the right side wall 3, either straight or with the elbow bent. The arm may be moved back so that the elbow is protruding beyond the user's back plane without any interference with the back board. Alternatively if the right arm is moved forward and extends beyond the chest and stomach plane, the arm still rests above the right side wall and the hand becomes supported by the right hand support 6 in FIGS. 1 and 4B.

The angle restrictors 7,8, typically made of 5-15 mm thick steel rods or bars but can be made of other suitable material such as plastic or resin. The angle restrictors 7, 8 can have a different shape and attachment site while providing the same functionality.

The upholstery 40 which makes the side walls 2,3 is suspended on the supporting rods 16,17,19,20 with attached straps, extends from the armpits to the pelvis and serves to comfortably support the body weight while allowing close positioning of user's arms to the body. The upholstery 40 as shown here is made of soft and durable fabric and filled with foam.

Alternatively, the upholstery can be made of stretchable fabric or any other type of material that follows contours of the body and supports the torso comfortably.

The supporting rods 16,17,19,20 and upholstery 40 may be permanently attached to the back board 1. In other embodiments the rods 16,17,19,20 and upholstery 40, are attached to the back board 1 via hinges 41 coupled with a latch-and-release mechanism so that the side walls 2,3 can swing open and facilitate user's loading into the frame 4 and getting out of the frame.

Alternatively, the side walls 2,3 and/or head support 9 may be coupled to the back board 1 with springs, a pneumatic or hydraulic dampener or system, or any other suitable manner without departing from the scope of the invention.

The left and right openings, together with the frame, permit the user to position each arm below the torso support without the torso weight on the shoulder or arm. The user's arm may be supported by another support system, such as pockets or sleeves (not shown) sewn onto the side wall's 2,3 upholstery 40, a bed, or the support surface on which the device rests (such as simply resting the arm on the floor).

In the preferred embodiment, the device is equipped with the head support 9 attached to the back board 1. The head support 9 ensures proper positioning of the head for relaxed sleep and eliminates the need for a pillow. The head support 9 may be made of steel, plastic, plywood, or other suitable material. The head support 9 is attached to back-board 1 of the frame 4 and extends to approximately top of the head. The head support is 1-15 cm wider than sleeper's head width. On the sides head support 9 extend from base of the neck to the top of the head. In the preferred embodiment, and as illustrated in the Figures, the sides follow the shape of the body below the base of the neck and provide additional support for comfortable sleep. Soft padding on the inner sides of head support is made of memory foam or other suitable material and contoured to the shape of neck, face, and head such that head and neck are fully and comfortably supported for relaxed sleep. The head support 9 may be further equipped with a chin strap (not shown) that will prevent the mouth from opening during sleep. This further reduces the tendency for apnea. The head support may be further fitted with a top piece to keep top of the head warm.

The frame 4 may be further equipped with a left shoulder-brace 21 and a right shoulder brace 22 that pull the shoulders back, prevent slouching FIGS. 4A,B, and facilitate relaxation of the upper back and chest muscles. This improves sleep comfort and retrains muscles for improved posture. The left shoulder brace 21 is coupled to at least one of the frame 4 and the head support 9, the left shoulder brace 21 being movable to adjust a distance 42 in FIG. 4A between the left shoulder brace pad 43 and the back board 1. The right shoulder brace coupled to at least one of the frame 4 and head support 9, the right shoulder brace 22 being movable to adjust a distance 44 between the right shoulder brace pad 45 and the back board 1. The left shoulder brace 21 shoulder brace pad 43 are configured to apply a force to the user's left shoulder to position the left shoulder in a desired position. The right shoulder brace 22 and shoulder brace pad 45 also being configured to apply a force to the user's right shoulder to position the right shoulder in a desired position. The shoulder braces are attached to the back board 1 and extend above the shoulders to the front of the shoulders to approximately armpits. The shoulder braces 21, 22 may be fixed or fitted with a mechanism that allows the user to change position and/or pressure on the fore-shoulders. In another embodiment shoulder braces may be attached to the head support 9 without departing from the scope of the invention.

In the preferred embodiment, the frame 4 is used together with leg support 11 for improved comfort and alignment of the sleeper's legs and torso. As depicted in FIG. 2, the leg support 11 includes a central wall 23 being positioned between the legs of the user, the central wall 23 supporting the right leg and preventing the right leg from exerting weight on the left leg when the frame 4 and leg support 11 are in the left orientation, the central wall 23 supporting the left leg and preventing the left leg from exerting weight on the right leg when the frame 4 and leg support 11 are in the right orientation. The leg support 11 also has a left outer wall 24 coupled to the central wall 23 which supports the left leg when the left leg is lower than the right leg, the leg support also includes a right outer wall 25 coupled to the central wall 23 which supports the right leg when the right leg is lower than the left leg. The leg support also has a left groove 26 formed by the central wall 23 and the left outer wall 24, the user's left leg being positioned in the left groove and a right groove 27 formed by the central wall 23 and the right outer wall 25, the user's right leg being positioned in the right groove 27. The leg support 11 has a left support surface 28 and a right support surface 29, the leg support being supported by the left support surface 28 when the leg support 11 is in the left orientation as depicted in FIG. 28, the leg support 11 being supported by the right support surface 29 when the leg support is in the right orientation. The leg support 11 also has the middle support surface 30 and being supported by the middle support surface when user's legs are on the same level. The leg support 11 may be made with any number of support surfaces to provide any number of orientations for the user while the preferred embodiment includes only the right, left and middle orientations.

The support surfaces 28,29,30 determine the angle at which the legs are held with respect to the sleep surface and thus maintain alignment of the legs and torso. The support surfaces 28,29,30 are formed by the shaped braces 31 as depicted in FIGS. 1,2,3,5A,B made of plastic, steel or other suitable material. Alternatively, the support surfaces 28,29,30 may be formed by the surfaces of a single piece leg support carved out of polystyrene foam, polyurethane foam, cork, or similar material that combines benefits of low density, sufficient mechanical strength and can be easily carved or molded. The leg support 11 is made to fit the shape and size of the individual user or may be adjustable to fit different size users. The central wall 23 holds the legs, more specifically thighs and knees, separated while allowing the lower parts of the legs to remain either separated, or in contact, or partially crossed. The central wall 23 maintains alignment of the legs relative to each other and the hips and reduces pressure on the leg positioned closer to the sleep surface or ground (right leg when sleeping on the right side and left leg while sleeping on the left side). The dimensions of leg support 11 are such that it extends from upper end of hamstrings or lower end of buttocks to the ankles, feet, or slightly past the feet. The grooves 26,27 in which user's legs reside are deep enough to hold the legs in comfort while in lateral decubitus position. In its simplest form leg support 11 is made of polystyrene foam, polyurethane foam, cork, or similar material that combines benefits of low density, sufficient mechanical strength and can be easily carved or molded. In its preferred embodiment leg-support 11 is made of perforated plastic sheets (as shown here), or metal sheets, wire, or mesh, and padded with soft material such as foam. The leg support 11 can also be made of foam(s), rubber(s) or plastic(s) using molding techniques. Perforated plastic or metal sheets (wire/mesh) are preferred because these materials dissipate heat and perspiration. The leg support 11 may be fitted with an arch above the feet to prevent a heavy blanket from putting excessive pressure on the feet.

Figure 5B:
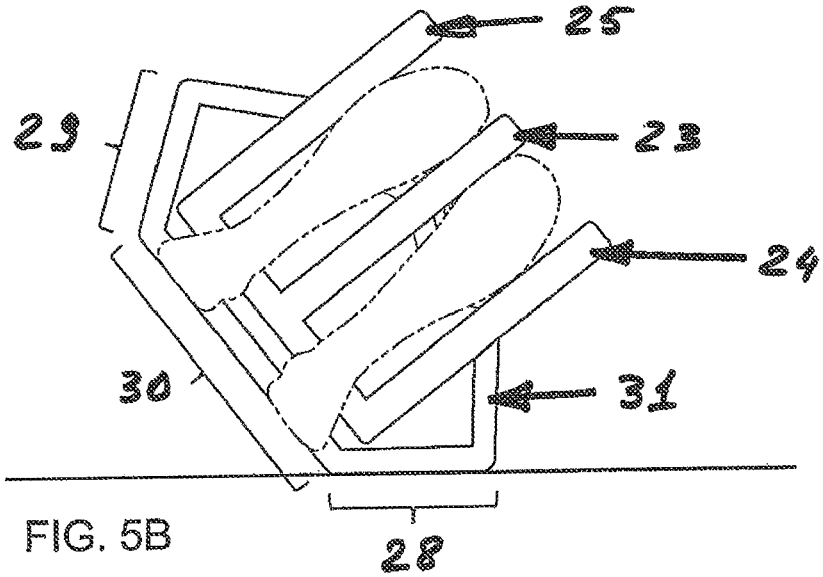
FIG. 5B. Leg-end view in the left orientation (left lateral decubitus position).

The distinctive feature of the leg support of this invention is the presence of defined left and right support surfaces 28 and 29. The sleep surfaces may be modified to match the angle at which the individual user prefers to sleep. In the preferred embodiment, the support surfaces of leg support are configured such that the user is leaning 45-65° (frontal plane relative to sleep surface FIG. 5B). These angle limits provide the best weight distribution between the side and the back of the user and promote better rest.

In the preferred embodiment the back board 1 of the frame 4 and leg support 11 are coupled via a seat 12 as shown in FIG. 2. The seat 12 is made according to sleeper's size and shape. The seat 12 is made of perforated plastic sheets, or metal sheet, wire, or mesh, and padded with soft material such as foam. The seat 12 can also be made of foam(s), rubber(s) or plastic(s) using molding techniques. Perforated plastic or metal sheets (wire/mesh) are preferred because these materials dissipate heat and perspiration. Connection of the seat 12 to leg support 11 and back board 1 can be made via a set of straps or hinges. A semi-rigid construction and connection are preferred to allow for flexibility while turning from side to side and while adjusting the hip to torso angle in left or right positions.

Figure 6:
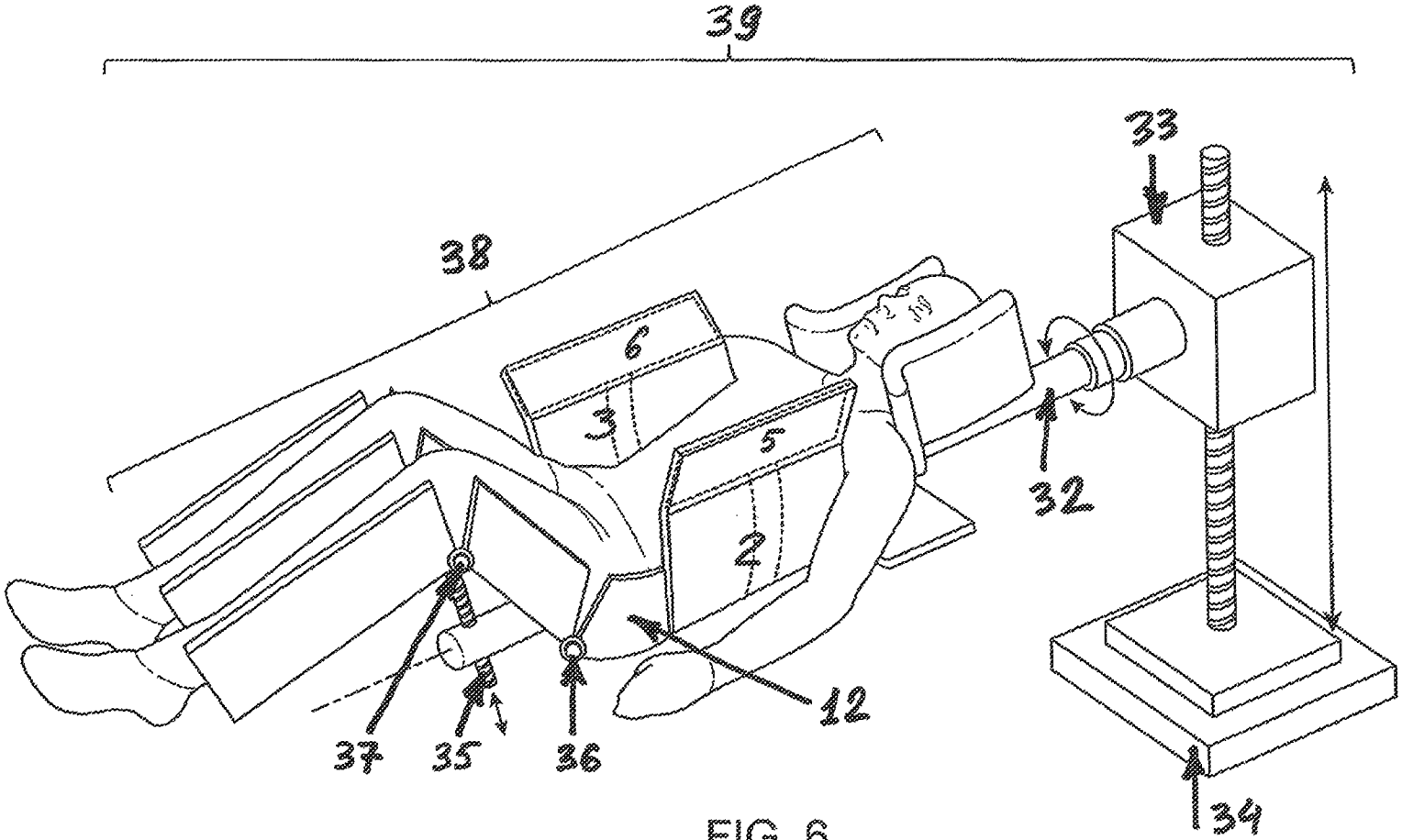
FIG. 6. The system (comprised of the frame with attached head support and hand support, seat, and leg support) mounted on an axle with resting user. Hinges located at the hip and knee joints provide additional flexibility and range of motion for the legs. The axle is coupled to a motor and gear, and rotates to the left and right. Motor and gear are coupled to the base and configured such that the system with resting user can be moved up and down.

Another system 38 for supporting a user is shown in FIG. 6 wherein the same or similar reference numbers shall refer to the same or similar structure. All features discussed in association with other preferred embodiments are equally applicable here and those features discussed here, where applicable, are also equally applicable to the other embodiments described herein. For example, the range of motion of any aspect of the invention, or user, associated with another embodiment are equally applicable here. Furthermore, it is understood that discussion related to any elements shown in the system 38 of FIG. 6 similar to other elements shown, such as the shoulder braces, are equally applicable here and all discussion and claims related to those aspect are equally applicable here.

The system 38 includes the frame 4, head support 9, leg support 11, and connecting seat 12 coupled to an axle 32. The frame 4, via axle 32, is movably coupled to a base 34 which rests on the ground, the frame 4 being movable relative to the base 34 to move the frame 4 from the left orientation to the right orientation as well as up and down. The base 34 may rest on the floor, be attached to the wall(s) or ceiling or anchored to any other suitable object. The system 38 may be movable by hand (human powered) or may be equipped with a motor 33 coupled to at least one of the bases 34 and the frame 4, the motor 33 being configured to move the frame 4 relative to the base 34 so that the frame 4 moves between the left, right and middle orientations. The frame 4 may, of course, also be positioned at any position between the right and left orientations and fixed in that orientation. The motor and gear 33 can also be configured to raise the frame 4 relative to the base 34. The system 39 thus incorporates system 38 and other parts enabling support and repositioning of system 38. The motor and a gear 35 are coupled to a leg support 11. The leg support 11 is coupled to the frame 4 via a hinge 36 and also includes a hinge 37 at the knee joint to change an angle of the user's knees and hips supported by the leg support 11. In this embodiment, as depicted in FIG. 6, the leg support 11 is split into two parts: the under-thigh part and the under-calf part. Motors, gears and electric controls can be configured for effortless change of the system into infinite number of positions. The head to legs inclination angle can be from flat or negative to 45-60° degrees or higher (high Fowler's). An additional lifting mechanism can be placed between the axle and feet end of the leg support 11 for extra mobility. The axle may be a continuous solid axle or made of two or more axles connected via universal joint, double Cardan, Thompson coupling or similar devices known in art. Having the axle split in two may enable raising the torso without raising the feet. In another embodiment, the axle 32 is coupled to the base 34 and the lifting mechanism is placed between the axle 32 and the frame 4. The grooves 26,27 in the leg support 11 can be separated to allow each leg being bent at a different angle for higher comfort. Movement may be exerted by electric motors, pneumatic, hydraulic, or other power and gear devices known to those skilled in the art. The control system can be operated by the sleeper, nurse, or by an electronic control device (programmable or sensor based), which allows automatic continuous or intermittent change of positions. The programmed operation of system 39 is useful during sleep to prevent discomfort, formation of bed sores, accumulation of fluid in the lungs, to improve blood flow and prevent thrombosis. Programmed operation is particularly useful in care for fully and partially immobile patients, and unconscious patients such as ones in coma.

The present invention has been described in connection with preferred embodiments, however, it is understood that the invention may be practiced in numerous other ways without departing from the scope of the invention. For example, the frame may be suspended by tension wires, pulleys or rollers without departing from numerous aspects of the present invention.

What is claimed is:

1. A device for supporting a user, comprising:

a back board which supports a torso of the user;

a left side wall connected to the back board for supporting the torso when the device has been rotated into a left orientation in which the user's left arm is below the torso, the left side wall extending from the user's left armpit along the user's body and further comprising:

a pair of supporting rods spaced parallel from each other and the back board, and spaced apart from each other by a distance that approximates a depth of the torso;

one or more connecting structures that connect the supporting rods to the back board; and fabric that stretches between the pair of supporting rods, forming a surface for contact with the torso, and allowing the user's left arm to rest against the fabric and in proximity to the torso when the device is in the right orientation;

a right side wall connected to the back board for supporting the torso when the device has been rotated into the right orientation, the right side wall extending from the user's right armpit along the user's body and further comprising:

a second pair of supporting rods spaced parallel from each other and the back board, and spaced apart from each other by the distance that approximates the depth of the torso;

one or more second connecting structures that connect the second pair of supporting rods to the back board; and fabric that stretches between the second pair of supporting rods, forming a second surface for contact with the torso, and allowing the user's right arm to rest against the fabric and in proximity to the torso when the device is in the left orientation.

2. The device of claim 1, wherein:
the back board is further configured to support the user in a middle orientation, wherein the user's arms are positioned at the same elevation, the middle orientation selected from the group consisting low Fowler's position, semi-Fowler's position, Fowler's position and high-Fowler's position.
3. The device of claim 1, further comprising:
a hump configured so as to elevate the user's head 20-70 cm above the ground when the device is in the middle orientation.
4. The device of claim 1, wherein:
the device is configured to support the user in the left, right, and middle orientations only.
5. The device of claim 1, wherein:
the back board comprises a left elbow recess in which the user's left elbow may be positioned, and a right elbow recess in which the user's right elbow may be positioned.
6. The device of claim 1, further comprising:
a motor mounted to a base; and
an axle connecting the motor to the device;
wherein the motor is configured to rotate the device between the left orientation and the right orientation.
7. The device of claim 6, wherein:
the motor being configured to raise the back board relative to the motor.
8. The device of claim 6, further comprising:
a control system which activates the motor to rotate the device between the left and right orientations.
9. The device of claim 6, wherein:
the control system automatically activates the motor to rotate the device between the left and right orientations.
10. The device of claim 6, wherein:
the motor is coupled to a leg support, the leg support having a central wall, a right outer wall, a left outer wall, a right groove and a left groove, the right outer wall and the central wall forming the right groove and the left outer wall and the central wall forming the left groove, the legs being positioned in the left and right grooves, the motor being coupled to the leg support to change an angle of the user's knees and hips supported by the leg support.
11. The device of claim 1, further comprising:
padding material;
wherein the fabric is filled with the padding material.
12. The device of claim 1, wherein:
the device changes an orientation of the user by at least 90 degrees when moving between the left orientation and the right orientation.
13. The device of claim 1, wherein:
the device may be positioned at any orientation between the left and right orientations.
14. The device of claim 1, further comprising:
an angle restrictor mounted to the back board and projecting away from a surface of the back board that supports the torso to stabilize the device in a left or right orientation.
15. The device of claim 1, further comprising:
a leg support, the leg support comprising a central wall positioned between the user's legs, a left outer wall, and a right outer wall, the left outer wall and central wall forming a left groove in which the user's left leg is positioned, and the right outer wall and central wall forming a right groove in which the user's right leg is positioned.
16. The device of claim 15, wherein:
the leg support is coupled to the back board.
17. The device of claim 16, further comprising:
an angle restrictor mounted to the leg support to stabilize the device in a left or right orientation.
18. The device of claim 15, wherein:
the leg support is not coupled to the back board.
19. The device of claim 15, wherein:
the leg support includes an under calf part and an under thigh part, the under calf and under thigh parts being movable to change an angle of the user's knees and hips supported by the leg support.
20. The device of claim 1, further comprising:
a head support coupled to the back board which supports the user's head in the left, right and middle orientations and any orientation therebetween.
21. The device of claim 1, further comprising:
a head support coupled to the back board;
a left shoulder brace coupled to at least one of the back board and the head support, the left shoulder brace being movable to adjust a distance between the left shoulder brace and the back board; and
a right shoulder brace coupled to at least one of the back board and the head support, the right shoulder brace being movable to adjust a distance between the right shoulder brace and the back board.
22. The device of claim 21, wherein:
the left shoulder brace is configured to apply a force to the user's left shoulder to position the left shoulder in a desired position; and
the right shoulder brace also being configured to apply a force to the user's right shoulder to position the right shoulder in a desired position.
23. The device of claim 1,wherein:
the right side wall and the left side wall are movable with respect to the back board to permit introduction of the user to the device.
24. The device of claim 1, further comprising:
a hinge that connects at least one of the left and right side walls to the back board, thereby permitting introduction of the user to the device.
25. The device of claim 1, further comprising:
padding material;
wherein the padding material is placed over each pair of supporting rods to form the surface against which the torso rests.
26. A device for supporting a user, comprising:
a back board which supports a torso of the user;
a left side wall connected to the back board for supporting the torso when the device has been rotated into a left orientation in which the user's left arm is below the torso, the left side wall extending from the user's left armpit along the user's body, the left side wall comprising a structure that allows the user's left arm to rest in close proximity to the torso when the device is in a right orientation in which the user's right arm is below the torso;
a right side wall connected to the back board for supporting the torso when the device has been rotated into the right orientation, the right side wall extending from the user's right armpit along the user's body, the right side wall comprising a structure that allows the user's right arm to rest in close proximity to the torso when the device is in the left orientation; and a single hump coupled to the back board, the hump comprising a curved portion in contact with the ground, placing the device at an angle with respect to the ground and allowing the device to be manually rotated into either the left orientation or the right orientation.

* * * * *